US006124250A

United States Patent [19]

Olson et al.

[11] Patent Number: 6,124,250

[45] Date of Patent: Sep. 26, 2000

[54] METHOD OF MAKING HIGHLY ALKALINE SOLID CLEANING COMPOSITIONS

[75] Inventors: Keith E. Olson, Apple Valley; James Thorson, Scandia; Diane K. Johnson, St. Paul, all of Minn.

[73] Assignee: Ecolab Inc., St. Paul, Minn.

[21] Appl. No.: 08/977,035

[22] Filed: Nov. 25, 1997

Related U.S. Application Data

[63] Continuation of application No. 08/176,541, Dec. 30, 1993, abandoned.

[51] Int. Cl.[7] ..... C11D 9/44

[52] U.S. Cl. ..... 510/108; 510/218; 510/224

[58] Field of Search ..... 510/108, 218, 510/224, 225, 440, 445, 447, 451

[56] References Cited

U.S. PATENT DOCUMENTS

| | | | |
|---|---|---|---|
| Re. 32,763 | 10/1988 | Fernholz et al. | 252/90 |
| Re. 32,818 | 1/1989 | Fernholz et al. | 252/90 |
| 2,164,092 | 6/1939 | Smith | 23/107 |
| 2,559,583 | 7/1951 | Barker | 252/152 |
| 2,559,584 | 7/1951 | Barker | 252/152 |
| 2,561,392 | 7/1951 | Marshall | 117/100 |
| 2,584,056 | 1/1952 | Soule et al. | 252/106 |
| 2,584,057 | 1/1952 | Soule et al. | 252/106 |
| 2,665,256 | 1/1954 | Barker | 252/152 |
| 2,824,091 | 2/1958 | Desty et al. | 260/96.5 |
| 2,927,900 | 3/1960 | Shiraeff | 252/152 |
| 3,046,232 | 7/1962 | Bonewitz | 252/156 |
| 3,066,354 | 12/1962 | Chaffee et al. | 18/47.5 |
| 3,324,038 | 6/1967 | Chaffee et al. | 252/152 |
| 3,390,093 | 6/1968 | Feierstein et al. | 252/138 |
| 3,398,219 | 8/1968 | Kelly et al. | 264/102 |
| 3,554,915 | 1/1971 | Keay et al. | 252/99 |
| 3,639,286 | 2/1972 | Ballestra et al. | 252/109 |
| 3,803,285 | 4/1974 | Jensen | 264/143 |
| 3,858,854 | 1/1975 | Win et al. | 252/89 |
| 3,887,614 | 6/1975 | Susuki et al. | 252/531 |
| 4,119,578 | 10/1978 | Daeninckx et al. | 252/548 |
| 4,203,857 | 5/1980 | Dugan | 252/92 |
| 4,219,435 | 8/1980 | Biard et al. | 252/90 |
| 4,219,436 | 8/1980 | Gromer et al. | 252/135 |
| 4,289,525 | 9/1981 | Pasarela et al. | 71/92 |
| 4,370,250 | 1/1983 | Joshi | 252/135 |
| 4,427,558 | 1/1984 | David | 252/8.8 |
| 4,510,110 | 4/1985 | Mazzoni | 264/176 R |
| 4,517,107 | 5/1985 | Clarke et al. | 252/108 |
| 4,541,831 | 9/1985 | Gunther et al. | 8/648 |
| 4,569,780 | 2/1986 | Fernholz et al. | 252/90 |
| 4,569,781 | 2/1986 | Fernholz et al. | 252/92 |
| 4,587,029 | 5/1986 | Brooks | 252/91 |
| 4,587,031 | 5/1986 | Kruse et al. | 252/135 |
| 4,595,520 | 6/1986 | Heile et al. | 252/160 |
| 4,615,819 | 10/1986 | Leng et al. | 252/110 |
| 4,624,713 | 11/1986 | Morganson et al. | 134/25.2 |
| 4,680,134 | 7/1987 | Heile et al. | 252/160 |
| 4,681,914 | 7/1987 | Olson et al. | 252/91 |
| 4,695,284 | 9/1987 | Hight | 8/137 |
| 4,722,802 | 2/1988 | Hutchings et al. | 252/174 |
| 4,725,376 | 2/1988 | Copeland | 252/90 |
| 4,753,755 | 6/1988 | Gansser | 252/527 |
| 4,798,724 | 1/1989 | Khanna | 424/480 |
| 4,846,989 | 7/1989 | Killa | 252/99 |
| 4,861,518 | 8/1989 | Morganson et al. | 252/548 |
| 4,879,063 | 11/1989 | Wood-Rethwill et al. | 252/370 |
| 4,911,856 | 3/1990 | Lokkesmoe et al. | 252/95 |
| 4,915,865 | 4/1990 | Westermann et al. | 252/157 |
| 4,931,202 | 6/1990 | Cotter et al. | 252/99 |
| 4,933,100 | 6/1990 | Ramachandran | 252/95 |
| 4,933,102 | 6/1990 | Olson | 252/174 |
| 4,971,714 | 11/1990 | Lokkesmoe et al. | 252/95 |
| 5,019,346 | 5/1991 | Richter et al. | 422/28 |
| 5,061,392 | 10/1991 | Bruegge et al. | 252/135 |
| 5,064,554 | 11/1991 | Jacobs et al. | 252/99 |
| 5,066,425 | 11/1991 | Ofosu-Asante et al. | 252/546 |
| 5,156,794 | 10/1992 | Nakanishi et al. | 264/349 |
| 5,198,198 | 3/1993 | Gladfelter et al. | 422/264 |
| 5,234,615 | 8/1993 | Gladfelter et al. | 252/90 |
| 5,316,688 | 5/1994 | Gladfelter | 252/90 |

FOREIGN PATENT DOCUMENTS

| | | |
|---|---|---|
| 0178893 | 4/1986 | European Pat. Off. . |
| 1031831 | 6/1966 | United Kingdom . |
| 89/11753 | 11/1989 | WIPO . |
| 92/13061 | 8/1992 | WIPO . |

*Primary Examiner*—Lorna M. Douyon
*Attorney, Agent, or Firm*—Merchant & Gould P.C.

[57] ABSTRACT

The invention provides a process for preparing a highly alkaline, solid cleaning composition in a batch or continuous mixing system, at or below the melting temperature of the alkaline ingredients, and products produced by the process. Preferably, the ingredients are processed in an extruder, and the mixture is extruded directly into a mold or other packaging system for dispensing the cleaning composition. The consistency of the product ranges from that of a fused block solid to a malleable product. The highly alkaline cleaning compositions are useful for warewashing and cleaning hard surfaces, rinsing, sanitizing, deodorizing, laundry detergents, and the like.

28 Claims, 5 Drawing Sheets

METHOD OF MAKING HIGHLY ALKALINE SOLID CLEANING COMPOSITIONS

This is a Continuation of application Ser. No. 08/176,541, filed Dec. 30, 1993 now abandoned.

FIELD OF THE INVENTION

The invention is directed to a process for manufacturing homogeneous, highly alkaline, solid cleaning compositions, as for example, ware and/or hard surface cleaning compositions, and sanitizing additives, that include a hydratable, alkaline source as a primary cleaning agent, and additive agents such as detergent adjuvants as desired. The cleaning compositions are prepared preferably in a continuous mixing system, more preferably in an extruder, without the need for a molten phase. The compositions solidify after processing is completed and have little or no post-solidification swelling.

BACKGROUND OF THE INVENTION

The development of solid block cleaning compositions has revolutionized the manner in which detergent compositions are dispensed by commercial and institutional entities that routinely use large quantities of cleaning materials. Solid block compositions offer unique advantages over the conventional liquids, granules or pellet forms of detergents, including improved handling, enhanced safety, elimination of component segregation during transportation and storage, and increased concentrations of active components within the composition. Because of these benefits, solid block cleaning compositions, such as those disclosed in U.S. Pat. No. RE 32,763, U.S. Pat. No. RE 32,818, U.S. Pat. Nos. 4,680,134 and 4,595,520, have quickly replaced the conventional composition forms in commercial and institutional markets.

Various attempts have been made to develop a process for converting a liquid cleaning composition to a solid mass for containment and dispensing of the active ingredients during use. For example, the ingredients of the cleaning composition have been combined and subjected to melting temperatures to achieve a homogeneous mixture in that is commonly referred to as a "molten process," and then poured into a mold and cooled to a solid form.

Solid alkaline detergent compositions have also been prepared from an aqueous emulsion of detergent ingredients and substances that will hydrate to bind free water in the emulsion which, optionally after heating and cooling, hardens to a solid. For example, U.S. Pat. Nos. 4,595,520 and 4,680,134 to Heile et al., disclose a solid alkaline detergent formed from an aqueous emulsion containing a sodium condensed phosphate hardness sequestering agent and an alkaline builder salt such as sodium hydroxide, which is solidified by incorporating a hydratable hardening agent such as an anhydrous sodium carbonate and/or sodium sulfate. Preferably, the emulsion is heated to form a molten mass, and then cooled to effect solidification. U.S. Pat. No. 5,064,554 to Jacobs et al., discloses a solid detergent in the form of a fused block that is manufactured by preparing a melt of alkali metal silicate, alkali metal hydroxide, optionally water, an active chlorine donor and/or an organic complexing agent, combining the melt with a penta-alkali metal triphosphate, introducing the melt into a flow mixer, and pouring the molten mixture into a mold to solidify. U.S. Reissue Pat. No. RE 32,763 to Fernholz et al., discloses a method of manufacturing a solid block cleaning composition by forming an aqueous solution of two hydratable chemicals, such as sodium hydroxide and sodium tripolyphosphate, heating the solution to a temperature of about 65–85° C., increasing the concentration of the hydratable ingredients in the heated solution to provide a composition which is liquid at an elevated temperature and solidifies at about room temperature, and casting the heated solution into molds whereupon the composition solidifies upon cooling.

Solid block cleaning and sanitizing compositions and rinse aids provide a significant improvement over the conventional liquid, granular and pelletized cleaning compositions. Although the molten process is useful for preparing solid block compositions, time and expense would be saved if heating and cooling of the composition could be eliminated from the process. Also, lower process temperatures would better facilitate the use of heat-sensitive ingredients in cleaning compositions. In addition, less sturdy packaging would be required if the processed mixture could be dispensed at a lower temperature.

Attempts have been made to develop processes that decrease the amount of contact of thermally-sensitive ingredients with molten ingredients in order to minimize the deactivation of such ingredients. For example, U.S. Pat. No. 4,725,376 to Copeland, et. al., discloses manufacturing a solid block, alkaline cleaning composition by placing solid particles of the thermally-deactivatable ingredient into a mold, pouring the molten alkaline ingredient over the solid particles so it percolates into the interstitial spaces, and then cooling the melt to a solid form. The resulting solid block cleaning composition comprises granules of the thermally-deactivatable ingredient uniformly dispersed throughout the composition.

Other attempts have been made to improve and simplify the molten process by blending the ingredients without melt temperatures. For example, U.S. Pat. No. 4,753,755 to Gansser, discloses combining a hardness sequestering agent and an aqueous alkaline solution at a temperature of between 50–130° F. to form an alkaline liquid dispersion, and then adding a solidifying amount of a solid caustic material to the dispersion. U.S. Pat. No. 2,164,092 to Smith, discloses solidifying an aqueous alkaline solution by adding a metaphosphate compound under conditions which will convert the metaphosphate to an orthophosphate and/or pyrophosphate and hydrate the water to solidify the alkaline solution. While the processes of Gansser and Smith provide a method for the manufacturing solid block cleaning compositions without melt temperatures, the process of Gannser generally produces compositions that require extended mixing times and several hours to solidify, is limited to nitrilotriacetic acid compositions, may require hours to build viscosity to a level of substantially no flow, and requires three long mix times to prevent product separation, and Smith's process is limited to phosphate-based cleaning compositions.

Various attempts have also been made to manufacture cleaning compositions by an extrusion process. U.S. Pat. No. 5,061,392 to Bruegge et al., for example, discloses a method of forming a detergent composition having a paste-like consistency, by combining a first aqueous solution containing a potassium tripolyphosphate and a second aqueous solution containing a water-soluble, sodium-based detergent builder, namely sodium hydroxide. Upon mixing, the viscosity of the mixture rapidly increases to form a highly viscous paste. In another extrusion method, as disclosed in U.S. Pat. No. 4,933,100 to Ramachandran, an organic detergent of particulate or patty form is formed by kneading together a synthetic organic detergent, a hydratable builder salt such as sodium tripolyphosphate, and water. The mixture is passed through an extruder and forced through openings at or slightly above room temperature and a low pressure to form a rod-shaped extrudate. A disadvantage of these processes is that neither method provides a final product that is a fused solid block upon hardening.

Therefore, an object of the invention is to provide a process for manufacturing a solid, highly alkaline cleaning composition at a process temperature at or below the melt temperature of the ingredients. Another object is to provide a process for making a highly alkaline cleaning composition at a low processing temperature and high viscosity to achieve rapid solidification of the cast or extruded composition. A further object is to provide a process that will substantially eliminate swelling of the solid cast or extruded composition and product.

SUMMARY OF THE INVENTION

The invention is directed to a process for preparing a homogeneous, highly alkaline, solid cleaning composition comprising a source of alkalinity as a cleaning agent, and detergent adjuvants and additives as desired, in which no or minimal heat from an external source is applied during processing to melt the alkaline ingredients. Cleaning compositions which may be produced according to the present method include a wide variety of highly alkaline cleaning compositions for use, for example, in warewashing and cleaning hard surfaces, rinsing, sanitizing, deodorizing, and the like.

The process of the invention includes the steps of (a) mixing together a solid hydratable alkaline material and an aqueous alkaline medium in a suitable mixing system at high shear, at or below the melting temperature of the solid alkaline ingredient, to reduce the solid alkaline material to a particle size effective to provide a substantially homogeneous, solid alkaline matrix of the ingredients; the total amount of alkaline material in the matrix being about 65–95%; (b) discharging the alkaline matrix from the mixing system; and (c) allowing the alkaline matrix to harden to a solid composition. The alkaline ingredients may be combined with an additive agent, such as a thickening agent, secondary cleaning agent, defoaming agent, and the like, to form an alkaline matrix with the additive agent distributed throughout.

The alkaline matrix prior to discharge, has a viscosity effective to retain a shape upon being discharged from the mixer until the matrix solidifies to the solid composition, preferably about 1000–1,000,000 cps. The amount of the solid and aqueous alkali and the processing of the alkaline matrix is effective to achieve solidification of the discharged alkaline matrix substantially evenly throughout its mass with little or no deformative swelling during hardening.

The mixing system of the invention may be either a batch-type processing system equipped with both a high shear and mixing agitation, or preferably, a continuous-type processing system such as an extruder apparatus. The mixing system is capable of reducing the particle size of the solid alkaline material in an aqueous alkaline solution by shearing or grinding the solid, and of maintaining the mixture as a flowable mass during processing. A batch processing system may provide high shear mixing or wet grinding of the solid alkali, for example, in a tank or other like container. A continuous processing system may provide wet grinding or milling of the solid alkali, for example, in a high shear mixing zone of the mixing apparatus such as an extruder. The choice of the processing system used depends, at least in part, upon the viscosity of the alkaline matrix during processing. For example, a batch processing system may be used for preparing a matrix having a viscosity which allows it to be poured or pumped into a mold or other like receptacle. A continuous processing system is required for processing an alkaline matrix having a high viscosity which is not readily pourable or pumpable from the mixing system.

The invention provides a method of manufacturing a homogeneous, highly alkaline cleaning composition at a substantially lower temperature and a substantially higher viscosity than other methods such as a conventional "molten process" in which the ingredients are melted together to achieve a homogenous mixture. Preferably, the processing temperature of the alkaline matrix is maintained at or below the melting temperature of the alkaline ingredients, preferably at about 15–60° C., and the viscosity at about 1,000–1,000,000 cps. Optionally, external heat may be applied to the ingredients to a temperature of about 50–150° C. to facilitate processing, for example, during the mixing phase to decrease viscosity of the alkaline matrix, during the extruding step, and the like.

Preferably, the alkaline matrix is discharged from the mixer at below the melt temperature of the alkaline ingredients, preferably at about 15–60° C. It is preferred that the processed alkaline matrix "sets up" or starts to solidify within about 1 minute to about 3 hours, preferably within about 1–60 minutes, of being discharged from the mixer. Preferably, complete solidification or equilibration of the matrix to the composition is within about 5–48 hours of being discharged from the mixer, preferably within about 10–36 hours, preferably within about 15–24 hours. Solidification of the processed alkaline matrix to the composition is substantially simultaneous throughout its mass, with a reduced amount or no deformative swelling of the matrix during hardening.

A variety of highly alkaline cleaning compositions may be produced according to the present method. The types and amounts of ingredients that comprise a particular composition will vary according to its purpose and use, as for example, a laundry detergent, a composition for cleaning hard surfaces, rinsing, sanitizing, deodorizing, and the like. The processed composition will comprise an effective cleaning amount of an inorganic alkaline source derived from the combined solid and aqueous alkali ingredients, and one or more detergent adjuvants and/or other additives as desired. Preferably, the solid alkaline source is an anhydrous alkali which will hydrate to bind the free water of the aqueous alkaline medium and other aqueous ingredients in the alkaline matrix to cause the matrix to solidify after being discharged from the mixing system. Suitable additive agents include, for example, detergent adjuvants or fillers, such as a secondary alkaline source, sequestering agent, thickening agent, soil suspending agent, a bleaching agent, secondary hardening agent, solubility modifying agent, and other like agents.

Advantageously, in the method of the invention, a homogeneous, highly alkaline, solid cleaning composition may be provided by processing the alkaline ingredients at a temperature lower than that typically needed in other methods which require melting the ingredients. Since high melt temperatures are not required, problems with de-activation of thermally-sensitive ingredients in the mixture may be avoided. In addition, due to the lower temperatures used in the processing, little or no cooling of the alkaline matrix is required prior to being cast or extruded, for example, into a packaging wrapper, casing, mold, dispenser, and the like. The use of lower temperatures also broadens the options of packaging materials that may be used to contain the processed composition.

In addition, hardening of the cleaning composition after processing is accelerated since the end-process temperature of the alkaline matrix is closer to that required for solidification. Little or no cooling is required because the equilibration of the hydration reaction of the caustic substances occurs at a temperature lower than the melting point of the solid alkaline material.

The process of the invention also provides for solidification of the discharged alkaline matrix within a significantly reduced time as compared to other methods in the art, such as the cold process described in U.S. Pat. No. 4,753,755 to Gansser which discloses mixing but not milling the caustic bead into the mixture. By comparison, the process of the invention provides for wet milling of the caustic bead or other solid in an aqueous alkaline medium, or dry milling the bead. Although not intended to limit the scope of the invention, it is believed that, at least in part, the milling of the solid alkali increases the surface area of the solid caustic in the alkaline matrix resulting in a more rapid equilibration of the hydration reaction between the solid alkali (i.e., caustic) and the aqueous alkaline solution. It is further believed that wet milling of the caustic solid in the aqueous alkaline medium reduces the degree of density changes of the caustic solid in the solidifying alkaline matrix which, in turn, reduces swelling of the product.

The rapid solidification achieved by the present method minimizes segregation of the ingredients during hardening of the alkaline matrix to the solid composition, and speeds production of the solid product. Also, the uniform hydration of the anhydrous hydroxide achieved by the process helps minimize deformative swelling of the hardening alkaline matrix. This, in turn, reduces the amount of solid product which must be discarded due to unsightly and/or operationally interfering disfiguration.

In addition, the use of an extruder or similar device provides for continuous processing of the cleaning composition, easy clean-up, and a high level of control and repeatability of the formulation process. Further, a multi-chamber extruder provides segregation of chambers for sequential processing of the cleaning composition.

Advantageously, the invention provides a process for making an alkaline cleaning composition containing a lower amount of water and inert and filler ingredients, and substantially higher amounts of alkalinity and other active ingredients as compared to corresponding compositions prepared according to a conventional molten process. An additional benefit of the present process is that a higher concentration of active ingredients may be combined and processed as a homogeneous fluid mixture to provide a final product having a higher concentration of active ingredients compared to compositions produced by conventional molten processes. For example, it would be undesirable to use a molten process to prepare a composition containing greater than about 80% sodium hydroxide in the solid matrix because it would require heating the ingredients to the melting point of the solid sodium hydroxide, which would exceed the boiling point of water and significantly reduce the amount of water (of hydration), thereby causing rapid solidification of the mixture.

Another advantage of the present invention is that highly alkaline compositions may be prepared by continuous processing which have substantially higher viscosities and faster solidification rates once the alkaline matrix is discharged from the mixer, and significantly less settling of active ingredients which are distributed substantially uniformly throughout the entire mass of the product. As a result, separation and segregation of active ingredients in the product are substantially reduced compared to products prepared by conventional batch molten processes. In those processes a molten mixture is dispensed into a container and then cooled slowly using an external cooling source until the composition hardens. Such a process requires a significant amount of time and energy, and as product size increases, cooling and solidification time of the molten composition also increases. This leads to settling of the ingredients during solidification. The present invention overcomes those problems. As a result, products formed by the present invention are of a higher quality with significantly improved performance.

DETAILED DESCRIPTION OF THE INVENTION

Figure 1:
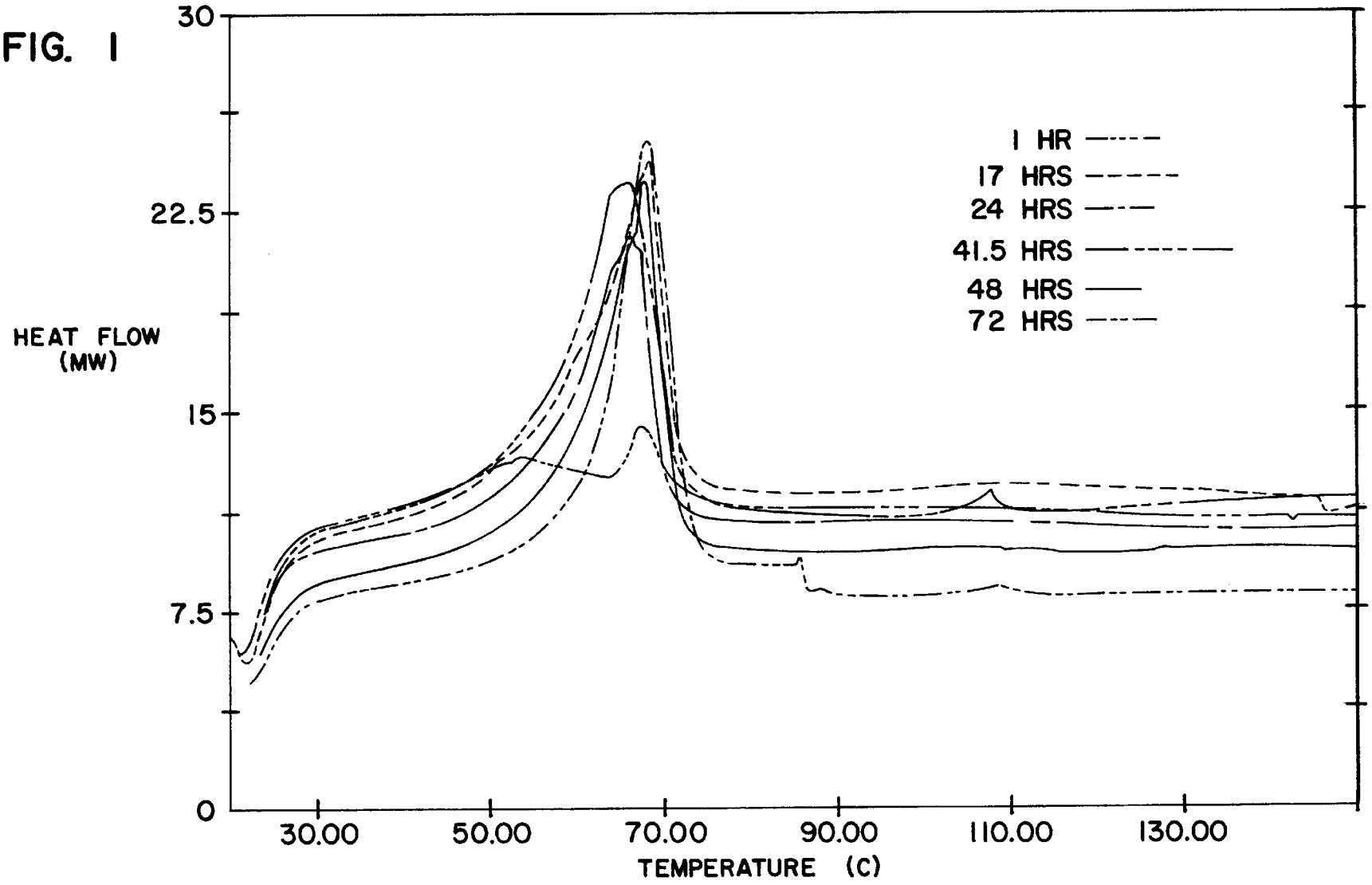
FIG. 1 is a graphic depiction of the DSC readings of a cleaning composition (second batch) for which the caustic bead was wet milled for 3 minutes (scanning rate 10.0 C/minute, sample weight 13.700 mg).

The present invention provides a process for manufacturing a variety of solid, highly alkaline, cleaning compositions. The method of the invention uses high shear mixing and lower processing temperatures than conventional methods which use melting temperatures, to produce a homogenous, highly alkaline matrix which hardens to a solid cleaning composition upon being discharged from the mixing system.

The solid alkaline source, preferably an alkali metal hydroxide, is wet milled in an aqueous alkaline medium to a particle size effective to achieve a homogenous mixture with the aqueous medium, and with the other ingredients in the mixture to form an alkaline matrix. The term "alkaline matrix" as used herein, describes a homogeneous, continuous phase in which a solid, hydrated alkaline source is distributed throughout and is maintained in suspension in an aqueous source such as an alkaline medium and/or water from an ingredient(s) of the formulation. After processing, the alkaline matrix is discharged from the mixing system, as for example, by casting or extruding, and the discharged matrix is allowed to harden to a solid form. Preferably, the solid and aqueous alkali ingredients are combined in an amount effective to initiate solidification of the alkaline matrix within about 1 minute to about 3 hours after being discharged from the mixing system, and to provide complete solidification of the alkaline matrix within about 5–48 hours after discharge from the mixer.

The highly alkaline compositions may be produced using a batch-type processing system or a continuous-type mixing system, preferably a single- or twin-screw extruder. One or more solid alkaline sources as a solidifying agent and cleaning agent is combined with an aqueous alkaline solution, and mixed at high shear to reduce the particle size of the solid alkali and form a homogeneous caustic matrix. Optionally, but preferably, one or more additive agents are combined with the caustic ingredients at a lower shear to mix the ingredients together and form a homogeneous matrix. The alkaline matrix is processed at a temperature at or below the melting temperature of the solid alkaline ingredient. The matrix may be dispensed from the mixer by extruding, casting or other suitable means. The discharged alkaline matrix is then allowed to harden to a solid form which ranges in consistency from a solid, dense block to a malleable, spongy, self-supporting form such as a coil, square or other shape. A highly alkaline cleaning composition made according to the method of the invention is substantially homogeneous with regard to the distribution of ingredients throughout its mass, and also substantially deformation-free.

Cleaning compositions which may be prepared according to the method of the invention include, for example, detergent compositions, ware and/or hard surface cleaning compositions, laundry products, and other like compositions. The highly alkaline cleaning compositions of the invention comprise conventional active ingredients that will vary in type and amount according to the particular composition being manufactured. The composition will include a source of alkalinity, such as an alkali metal hydroxide, derived from a solid and a liquid alkali source. Preferably, the solid alkaline source is a hydratable substance which will combine with the free water in the alkaline matrix to achieve a solid product.

A highly alkaline cleaning composition which may be produced according to the method of the invention, may comprise, for example, a phosphate or other hardness sequestering agent, an alkali metal silicate, an alkali metal condensed phosphate as a hardness sequestering agent, water and a source of active chlorine for cleaning and sanitizing. A detergent composition for removing soils and stains may include a major amount of an inorganic alkaline source such as an alkali metal hydroxide, an effective amount of water, and minor but effective amounts of a secondary cleaning agent such as a surfactant or surfactant system, as for example, a nonionic surfactant such as a nonylphenol ethoxylate or a polyethylene glycol fatty alcohol ether, a chelating agent/sequestering agent such as sodium tripolyphosphate, a secondary alkaline source such as a metal silicate, and/or a bleaching agent such as sodium hypochlorite, and the like.

As used herein, the term "solid" as used to describe the processed composition, means a hardened composition which will not flow perceptibly and will substantially retain its shape under moderate stress or pressure or mere gravity. The degree of hardness of the solid cast composition may range from that of a fused block solid which is relatively dense and hard, similar to concrete, to a consistency which may be characterized as malleable and sponge-like, similar to a caulking material.

Unless otherwise specified, the term "wt-%" is the weight of an ingredient based upon the total weight of the composition.

Alkaline Sources. The highly alkaline cleaning compositions produced according to the invention include an effective amount of one or more alkaline sources to enhance cleaning of a substrate and improve soil removal performance of the composition. The alkaline source is derived from a combination of solid and aqueous alkali ingredients.

Preferably, the solid alkali is an inorganic, anhydrous hydratable alkaline source. By the term "hydratable alkaline source," it is meant, a solid alkaline material which is capable of hydrating to bind free water present in the alkaline matrix, including the aqueous alkaline medium, to the extent that the alkaline matrix hardens to a homogenous solid composition. Hydratable alkaline substances suitable for use in the compositions processed according to the invention include, for example, alkali metal hydroxides such as a sodium or potassium hydroxide, and the like, with sodium hydroxide being preferred. Alkali metal hydroxides such as sodium hydroxides, are commercially available as a solid in the form of prilled beads having a mix of particle sizes ranging from about 12–100 U.S. mesh, and a mean particle size of about 500 microns.

The aqueous alkaline medium is preferably an aqueous solution of an alkali metal hydroxide such as potassium or sodium hydroxide, with a sodium hydroxide solution preferred. The aqueous alkaline medium is preferably an about 40–60% alkaline solution, preferably an about 45–55% solution. A preferred alkali solution is a sodium hydroxide solution, commercially available as a 50% solution.

According to the method of the invention, the solid hydratable alkaline source is combined with the aqueous alkaline medium in an amount effective to provide wet milling of the solid alkali to an effective particle size, and form a homogenous alkaline matrix. Other additive agents as desired, may be mixed with the caustic ingredients.

It can be appreciated that a caustic matrix tends to solidify due to the activity of a solid alkaline material in fixing the free water present in an aqueous alkaline medium as water of hydration. Premature hardening of the alkaline matrix during processing may interfere with mixing of the other ingredients to form a homogeneous matrix, and/or with casting or extrusion of the processed alkaline matrix. Accordingly, the amount of the solid alkali metal hydroxide and/or other hydratable alkaline source, and amount and dilution strength of the aqueous alkali (i.e., % solution) are effective to provide an alkaline matrix combined with other ingredients of a formulation, such that the ingredients may be processed as a homogeneous, flowable mixture, and will solidify within a desired period after being discharged from the mixing system, preferably within about 1 minute to about 3 hours.

The amount of solid alkali and aqueous alkaline solution included in the formulation will vary according to the percent water present in the total alkaline matrix, and the hydration capacity of the other ingredients. It is preferred that the amount of aqueous alkali included in the formulation is effective to provide a source of water for processing the ingredients into a homogeneous mixture, an effective level of viscosity for processing the ingredients, and/or a processed alkaline matrix with the desired amount of firmness and cohesion during discharge and hardening. Optionally, additional water may be included as desired, as a separate ingredient, or as part of an aqueous additive agent.

It is preferred that the alkaline matrix at the point of discharge from the mixer contains greater than about 8 wt-% of an aqueous alkaline medium, preferably about 16–88 wt-%, and most preferably about 33–63 wt-%. After being dispensed from the mixing system, the alkaline matrix will preferably comprise a water of hydration of greater than about 5 wt-%, preferably about 10–35 wt-%, preferably about 15–25 wt-%.

Additive Agents. The highly alkaline cleaning compositions may further include conventional detergent adjuvants such as a chelating/sequestering agent, bleaching agent, thickening agent, secondary cleaning agent, detergent filler, defoamer, anti-redeposition agent, a threshold agent or system, aesthetic enhancing agent (i.e., dye, odorant), and other like additives. Adjuvants and other additive ingredients will vary according to the type of composition being manufactured.

Chelating/Sequestering Agents. The composition may include a chelating/sequestering agent such as an aminocarboxylic acid, a condensed phosphate, a phosphonate, a polyacrylate, and the like. In general, a chelating agent is a molecule capable of coordinating (i.e., binding) the metal ions commonly found in natural water to prevent the metal ions from interfering with the action of the other detersive ingredients of a cleaning composition. A chelating agent may also function as a threshold agent when included in the matrix in an effective amount. Depending on the type of cleaning composition being formulated, a chelating/sequestering agent is included in an amount of about 0.1–70 wt-%, preferably from about 5–50 wt-%.

Useful aminocarboxylic acids include, for example, n-hydroxyethyliminodiacetic acid, nitrilotriacetic acid (NTA), ethylenediaminetetraacetic acid (EDTA), N-hydroxyethyl-ethylenediaminetriacetic acid (HEDTA), diethylenetriaminepentaacetic acid (DTPA), and the like.

Examples of condensed phosphates useful in the present composition include, for example, sodium and potassium orthophosphate, sodium and potassium pyrophosphate, sodium tripolyphosphate, sodium hexametaphosphate, and the like. A condensed phosphate may also assist, to a limited extent, in solidification of the composition by fixing the free water present in the alkaline matrix as water of hydration.

The composition may include a phosphonate such as aminotris(methylene phosphonic acid), hydroxyethylidene diphosphonic acid, ethylenediaminetetrae(methylene phosphonic acid), diethylenetriaminepente(methylene phosphonic acid), and the like. It is preferred to use a neutralized or alkaline phosphonate, or to combine the phosphonate with an alkali source prior to being added into the mixture such that there is little or no heat generated by a neutralization reaction when the phosphate is added.

The composition may contain a polyacrylate, as for example, a polyacrylate-coated tripolyphosphate hardness sequestering agent. Preferably, the polyacrylate is a neutral or alkaline substance, or is neutralized prior to being added to the mixture. Polyacrylates tend to interfere with the equilibration reaction of caustic ingredients in the composition which in turn, causes the product to swell during hardening. To avoid such swelling of the alkaline matrix and processed composition, it is preferred that the caustic bead or other solid form is wet-milled into an about 50% caustic solution prior to adding a polyacrylate material. It is also preferred that the polyacrylate be added as a powder to the mixture. This will also reduce the amount of phosphate reversion, for example, of a coated tripolyphosphate, and the like, during processing.

Polyacrylates suitable for use as cleaning agents include, for example, polyacrylic acid, polymethacrylic acid, acrylic acid-methacrylic acid copolymers, hydrolyzed polyacrylamide, hydrolyzed polymethacrylamide, hydrolyzed polyamide-methacrylamide copolymers, hydrolyzed polyacrylonitrile, hydrolyzed polymethacrylonitrile, hydrolyzed acrylonitrile-methacrylonitrile copolymers, and the like. For a further discussion of chelating agents/sequestrants, see Kirk-Othmer, *Encyclopedia of Chemical Technology*, Third Edition, volume 5, pages 339–366 and volume 23, pages 319–320, the disclosure of which is incorporated by reference herein.

Bleaching agents. Bleaching agents that may be used in a cleaning composition for lightening or whitening a substrate, include bleaching compounds capable of liberating an active halogen species, such as —Cl, —Br, —OCl and/or —OBr, under conditions typically encountered during the cleansing process. Suitable bleaching agents for use in the present cleaning compositions include, for example, chlorine-containing compounds such as a chlorine, a hypochlorite, chloramine, and the like. Preferred halogen-releasing compounds include the alkali metal dichloroisocyanurates, chlorinated trisodium phosphate, the alkali metal hypochlorides, monochloramine and dichloramine, and the like. Encapsulated chlorine sources may also be used to enhance the stability of the chlorine source in the composition (see, for example, U.S. Pat. No. 4,681,914, the disclosure of which is incorporated by reference herein). A cleaning composition may include a minor but effective amount of a bleaching agent, preferably about 0.01–10 wt-%, preferably about 0.1–6 wt-%.

Thickening Agents. The composition may include a thickening agent for suspending the ingredients in the alkaline matrix during processing and after discharge from the mixing system during hardening, and for increasing the viscosity of the alkaline matrix such that the discharged matrix will sustain a shape until hardening to the solid composition. Suitable thickening agents include, for example, clays, polyacrylates, cellulose derivatives, precipitated silica, fumed silica, zeolites, and other like substances, and mixtures thereof. A cleaning composition may include about 0.01–10 wt-% of a thickening agent, preferably about 0.5–5 wt-%.

Secondary Cleaning Agents. The composition may include one or more secondary cleaning agents in the form of a surfactant or surfactant system. A variety of surfactants can be used in a cleaning composition, including anionic, cationic, and nonionic surfactants, which are commercially available from a number of sources. For a discussion of surfactants, see Kirk-Othmer, *Encyclopedia of Chemical Technology*, Third Edition, volume 8, pages 900–912. Preferably, the composition comprises a cleaning agent in an amount effective to provide a desired level of soil removal and cleaning.

Nonionic surfactants useful in cleaning compositions include those having a polyalkylene oxide polymer as a portion of the surfactant molecule. Such nonionic surfactants include, for example, polyoxyethylene glycol ethers of fatty alcohols such as Ceteareth-27 or Pareth 25-7, and the like; carboxylic acid esters such as glycerol esters, polyoxyethylene esters, ethoxylated and glycol esters of fatty acids, and the like; carboxylic amides such as diethanolamine condensates, monoalkanolamine condensates, polyoxyethylene fatty acid amides, and the like; polyalkylene oxide block copolymers including ethylene oxide/propylene oxide block copolymers such as those commercially available under the trademark PLURONIC™ (BASF-Wyandotte), and the like; and other like nonionic compounds.

Anionic surfactants useful in the present polyethylene glycol-based cleaning compositions include, for example, carboxylates such as alkylcarboxylates and polyalkoxycarboxylates, and the like; sulfonates such as alkylsulfonates, alkylbenzenesulfonates, alkylarylsulfonates, sulfonated fatty acid esters, and the like;

sulfates such as sulfated alcohols, sulfated alcohol ethoxylates, sulfated alkylphenols, alkylsulfates, sulfosuccinates, alkylether sulfates, and the like; and phosphate esters such as alkylphosphate esters, and the like. Preferred anionics are sodium alkylarylsulfonate, alpha-olefinsulfonate, fatty alcohol sulfates, and the like.

Cationic surfactants useful for inclusion in a cleaning composition for sanitizing or fabric softening, include amines such as primary, secondary and tertiary monoamines with $C_{18}$ alkyl or alkenyl chains, amine oxides, ethoxylated alkylamines, alkoxylates of ethylenediamine, an imidazole such as a 2-alkyl-1-(2-hydroxyethyl)-2-imidazolines, a 1-(2-hydroxyethyl)-2-imidazolines, and the like; and quaternary ammonium salts, as for example, quaternary ammonium chloride surfactants such as n-alkyl($C_{12}$–$C_{18}$) dimethylbenzyl ammonium chloride, n-tetradecyldimethylbenzylammonium chloride monohydrate, a napthylene-substituted quaternary ammonium chloride such as dimethyl-1-napthylmethylammonium chloride, and the like; and other like surfactants.

Detergent Fillers. A cleaning composition may include a minor but effective amount of one or more of a detergent filler which does not perform as a cleaning agent per se, but cooperates with the cleaning agent to enhance the overall cleaning action of the composition. Examples of fillers suitable for use in the present cleaning compositions include sodium sulfate, sodium chloride, starch, sugars, and $C_1$–$C_{10}$ alkylene glycols such as propylene glycol, and the like. Preferably, a detergent filler is included in an amount of about 0.01–20 wt-%, preferably about 0.1–15 wt-%.

Defoaming Agents. A minor but effective amount of a defoaming agent for reducing the stability of foam may also be included in a cleaning composition. Preferably, the cleaning composition includes about 0.1–5 wt-% of a defoaming agent, preferably about 1–3 wt-%. Examples of defoaming agents suitable for use in the present compositions include silicone compounds such as silica dispersed in polydimethylsiloxane, fatty amides, hydrocarbon waxes, fatty acids, fatty esters, fatty alcohols, fatty acid soaps, ethoxylates, mineral oils, polyethylene glycol esters, alkyl phosphate esters such as monostearyl phosphate, and the like. A discussion of defoaming agents may be found in U.S. Pat. No. 3,048,548 to Martin et al., U.S. Pat. No. 3,334,147 to Brunelle et al., and U.S. Pat. No. 3,442,242 to Rue et al., the disclosures of both references incorporated by reference herein.

Anti-redeposition Agents. A highly alkaline cleaning composition may also include an anti-redeposition agent capable of facilitating sustained suspension of soils in a cleaning solution and preventing removed soils from being redeposited onto the substrate being cleaned. Examples of suitable anti-redeposition agents include fatty acid amides, fluorocarbon surfactants, complex phosphate esters, styrene maleic anhydride copolymers, and cellulosic derivatives such as hydroxyethyl cellulose, hydroxypropyl cellulose, carboxymethyl cellulose, and the like. A cleaning composition may include about 0.01–10 wt-%, preferably about 0.1–50 wt-%, of an anti-redeposition agent.

Dyes/Odorants. Various dyes, odorants including perfumes, and other aesthetic enhancing agents may also be included in the composition. Dyes may be included to alter the appearance of the composition, as for example, Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical Co.), Fluorescein (Capitol Color and Chemical), Rhodamine (D&C Red No. 19), Sap Green (Keystone Analine and Chemical), Metanil Yellow (Keystone Analine and Chemical), Acid Blue 9 (Hilton Davis), Sandolan Blue/Acid Blue 182 (Sandoz), Hisol Fast Red (Capitol Color and Chemical), Acid Green 25 (Ciba-Geigy), and the like.

Fragrances or perfumes that may be included in the compositions include, for example, terpenoids such as citronellol, aldehydes such as amyl cinnamaldehyde, a jasmine such as C1S-jasmine or jasmal, vanillin, and the like.

Processing of the Composition. The invention provides a method of processing highly alkaline cleaning compositions at lower temperatures and higher viscosities than are typically used when processing the same or similar composition by conventional methods such as a molten process. An alkaline matrix produced according to the present invention, after being discharged from the mixing system, exhibits reduced swelling, and requires little or no cooling and less time to solidify.

The mixing system may be a batch-type mixer, as for example, a Ross Laboratory Mixer (Model ME-100L) from Charles Ross & Son Co. Preferably, the mixing system is a continuous flow mixer, as for example, a Teledyne continuous processor, a Breadsley Piper continuous mixer, more preferably a single- or twin-screw extruder, with a twin-screw extruder being preferred, as for example, a multiple-section Buhler Miag twin-screw extruder.

Generally, in a molten process, the mixture is heated to the melting point of the ingredients, generally above about 60–90° C., which causes hydration of the alkali material. The molten mixture is then cooled, for example by freezing, to cause solidification of the composition. By comparison, the present invention is a "cold processing" method in which the mixture is maintained at a temperature at or below the melting point of the solid alkali, preferably at about 15–60° C.

The process includes wet milling the solid alkaline material such as a caustic bead, in an aqueous alkaline medium such as a 50% caustic solution, to reduce the solid alkali to an effective particle size, and form a viscous caustic matrix. The solid alkali is combined with an aqueous alkaline solution to prevent an exotherm in the alkaline matrix during processing.

The solid alkaline source is preferably a hydratable, anhydrous alkali metal hydroxide, such as sodium or potassium hydroxide. Preferably, the solid alkaline source is reduced, for example, by high shear mixing, to a particle size effective to provide rapid solidification, uniform hydrate distribution, and reduction in swelling of the final product. Insufficient reduction of the particle size of the solid alkaline material during processing may result in a longer solidification time required for hardening the processed composition, incomplete hydration of the solid alkali in the processed composition, and/or swelling of the final product during and/or after hardening. Reducing the particle size of the solid alkaline source also effectively increases the viscosity of the alkaline matrix prior to discharge from the mixing system. This in turn, reduces the separation of the active ingredients in the alkaline matrix and enhances an even distribution of the ingredients throughout the solid mass of the final product. Preferably, the average particle size of the solid alkali after milling is less than about 100 microns, preferably less than about 50 microns.

The aqueous alkaline medium is included in the mixture in an amount effective to provide water to equilibrate the solid alkaline source to the desired solid matrix hydration level, to maintain the alkaline matrix at a desired viscosity during processing, and to provide the processed matrix and final product with the desired amount of firmness and cohesion during discharge and hardening. Additional water may be included in the mixture as needed, as a separate ingredient, or as part of a liquid ingredient or premix.

Unlike a composition manufactured by a molten process, the mixtures processed according to the present method contain solid alkali which is not fully hydrated upon discharge of the alkaline matrix from the mixing system. Upon being discharged from the mixing system, the alkaline matrix will solidify by the slow hydration of the solid caustic to the equilibration point, at a temperature below the eutectic melting/freezing point, over a period of about about 5–48 hours.

Conventional detergent ingredients and other additive agents, may be combined with the caustic matrix as desired. An ingredient may be in the form of a liquid or solid such as a dry particulate, preferably a solid, and may be added to the mixture separately or as part of a premix with another ingredient. The solid alkali and aqueous alkali combine to form an alkaline matrix with the optional additive ingredients dispersed throughout the matrix.

An aqueous caustic matrix tends to be thermodynamically unstable and is driven to solidify to achieve a thermodynamic equilibrium. Accordingly, the mixing system provides for mixing of the ingredients at a shear effective to mix the ingredients together into a substantially homogeneous matrix and maintain the alkaline matrix at a flowable consistency. It is preferred that the alkaline matrix is maintained at a viscosity by which it may be stirred, mixed, agitated, blended, poured, extruded, and/or molded using conventional industrial mixing and/or shearing equipment of the type suitable for continuous processing and uniform distribution of ingredients throughout the mass. Preferably, the viscosity of the alkaline matrix during processing is about 1,000–1,000,000 cps. Although not intended to limit the scope of the invention, it is believed that, at least in part, the mixing of the alkaline ingredients at high shear enables the alkaline matrix to be processed at a significantly lower temperature than that needed in conventional processing methods in which the ingredients of the composition are melted to form a homogeneous matrix.

It is preferred that the alkaline matrix is processed at a temperature lower than the melting temperature of the alkaline ingredients of the composition, preferably about 1–90° C. lower, preferably about 5–20° C. lower. Although minimal or no external heat may be applied to the alkaline matrix during processing, it can be appreciated that the temperature achieved by the alkaline matrix may become elevated during processing due to variances in processing conditions, and/or by an exothermic reaction between ingredients. Optionally, the temperature of the alkaline matrix may be increased, for example at the inlets or outlets of the mixing system, by applying heat from an external source to achieve a temperature of about 50–75° C., preferably about 55–60° C., to facilitate processing of the matrix.

In general, the ingredients are processed at a pressure of at least about 5 psig, preferably about 5–6000 psig, most preferably about 5–150 psig. The pressure is applied as desired to maintain fluidity of the alkaline matrix during processing, to provide a force effective to urge the matrix through the mixer and discharge port, and the like.

The alkaline matrix is discharged from the mixing system by casting into a mold or other container, by extruding the matrix, and the like. Preferably, the alkaline matrix is cast or extruded into a packaging wrapper, casing, film, paperboard package, mold or other packaging system, that can optionally, but preferably, be used as a dispenser for the solid composition. It is preferred that the temperature of the alkaline matrix at the point of being discharged from the mixing system is sufficiently low to enable the alkaline matrix to be cast or extruded directly into a packaging system without first cooling the matrix. Preferably, the alkaline matrix at the point of discharge is at about ambient temperature, preferably about 15–80° C., preferably about 15–60° C. The alkaline matrix is then allowed to harden to a solid form which may range from a low density, sponge-like, malleable, caulky consistency to a high density, fused solid, concrete-like block.

Mixing Systems. The highly alkaline compositions may be processed according to the invention in a batch-type or continuous-type mixing system. For example, the composition may be prepared using a batch-type processing system, such as a Ross mixer, available commercially from Charles Ross & Son Co. (Model ME-100L), equipped with a stator head and fine screen head. First, the solid caustic may be wet milled in the aqueous alkali solution, and then another laboratory mixer may be operated at low shear to mix the caustic matrix with the other ingredients of the formulation. The alkaline matrix may then be poured or pumped from the mixing system, and allowed to harden.

The composition may also be prepared by using a continuous mixing system such as a Teledyne 2" model continuous mixer to wet mill the caustic bead into the caustic solution, and a Breadsley Piper continuous speed flow mixer to mix the remaining ingredients with the caustic mixture, as described in U.S. Pat. No. 3,730,487 and U.S. Reissue Pat. No. RE 29,387. For example, a sodium hydroxide bead and an about 50% aqueous sodium hydroxide solution may be fed into a Teledyne continuous mixer and mixed at high shear to wet grind the bead into the 50% solution. It is understood that the caustic may also be ground dry prior to its addition into the aqueous alkaline medium, alone or with other dry ingredients, using, for example, a suitable particle grinder such as a hammer mill or impact mill, and the like. The caustic matrix may then be transferred to a second mixer such as a Breadsley Piper continuous mixer, and additional ingredients such as a tripolyphosphate, preferably coated, a surfactant cleaning agent, and other optional ingredients such as an encapsulated chlorine source, may be added and mixed with the caustic ingredients.

In a preferred method according to the invention, the mixing system is a twin-screw extruder which may house two adjacent parallel rotating screws designed to co-rotate and intermesh. Preferably, the extruder has multiple barrel sections and a discharge port through which the matrix is extruded. The extruder may include, for example, one or more feed or conveying sections for receiving and moving the ingredients, a compression section, mixing sections with varying temperature, pressure and shear, a die section, and the like. A suitable twin-screw extruder commercially includes, for example, a Buhler Miag (62 mm) extruder available from Buhler Miag, Plymouth, Minn. USA.

Extrusion conditions such as screw configuration, screw pitch, screw speed, temperature and pressure of the barrel sections, shear, throughput rate of the matrix, water content, die hole diameter, ingredient feed rate, and the like, may be varied as desired in a barrel section to achieve effective processing of ingredients to form a substantially homogeneous liquid or semi-solid matrix in which the ingredients are distributed throughout the mass. To facilitate processing of the matrix within the extruder, it is preferred that the viscosity of the matrix is maintained at about 1,000–1,000,000 cps.

The extruder comprises a high shear screw configuration and screw conditions such as pitch, flight (forward or reverse) and speed effective to achieve high shear processing of the solid alkaline ingredient in the aqueous alkaline medium to reduce the solid alkali to an effective particle size, and form a homogenous alkaline matrix. Preferably, the screw comprises a series of elements for conveying, mixing, grinding, kneading, compressing, discharging, and the like, arranged to mix the ingredients at high shear and low shear, as desired, and convey the matrix through the extruder by the action of the screw within the barrel section. The screw element may be a conveyor-type screw, a paddle design, a metering screw, and the like. A preferred screw speed is at least about 20 rpm, preferably about 20–250 rpm.

Optionally, heating and cooling devices may be mounted adjacent the extruder to apply or remove heat in order to obtain a desired temperature profile in the extruder. For example, an external source of heat may be applied to one or more barrel sections of the extruder, such as the ingredient inlet section, the final outlet section, and the like, to increase fluidity of the matrix during processing through a section or from one section to another, or at the final barrel section through the discharge port. Preferably, the temperature of the alkaline matrix during processing including at the discharge port, is maintained at or below the melting temperature of the solid alkali matrix, preferably at about 50–150° C.

In the extruder, the action of the rotating screw or screws will mix the ingredients and force the mixture through the sections of the extruder with considerable pressure. Pressures within the mixing system is maintained at least 5 psig, preferably about 5–6,000 psig, most preferably up to about 5–150 psig, in one or more barrel sections to maintain the alkaline matrix at a desired viscosity level or at the die to facilitate discharge of the matrix from the extruder.

When processing of the ingredients is complete, the alkaline matrix may be discharged from the extruder through the discharge port, preferably a die. The pressure may also be increased at the discharge port to facilitate extrusion of the alkaline matrix, to alter the appearance of the extrudate, for example, to expand it, to make it smoother or grainier in texture as desired, and the like.

The alkaline matrix when discharged from the extruder has a viscosity that is high enough such that the shape of the discharged matrix will be substantially sustained until the matrix solidifies into a solid composition. Preferably, the viscosity of the alkaline matrix prior to discharge is about 20,000–1,000,000 cps. Viscosity of the matrix may be increased to that amount by the addition of one or more thickening agents such as clays, polyacrylates, celluloses, fumed silica, and other like substances.

It has also been found that viscosity may be increased by increasing the amount of alkali in the alkaline matrix. For example, an about 50% caustic solution containing an anhydrous material such as sodium hydroxide may be combined with the solid alkaline material to provide a matrix in which the total alkalinity is about 80–90%. It was unexpectedly found that such an increase in the total alkalinity of the alkaline matrix over conventional compositions containing about 65–75% alkalinity or less, provides a significant increase in the rate of solidification of the discharged alkaline matrix. Although not meant to be a limitation of the invention, it is believed that the increase in the solidification rate of the discharged matrix is due, at least in part, to an increase in the melting point of the solid matrix due to the high amount of alkali in the composition. This, in turn, increases the thermodynamic driving force for solidification to take place, thereby increasing the rate of solidification.

In addition, the viscosity and solidification rate of the alkaline matrix may also be increased by reducing the particle size of the solid alkaline source in the alkaline matrix. It was found that the rate of reaction between the solid and aqueous alkaline sources to form an alkaline matrix is directly related to the surface area contact between the solid and liquid alkali forms. Although not meant as a limitation on the invention, it is believed that by decreasing the particle size of the solid alkaline source by grinding, the available surface area of the solid alkaline form for contact with the liquid alkaline form is increased which, in turn, accelerates the rate of equilibration of the aqueous alkaline matrix to form an alkaline matrix resulting in a faster solidification rate to form the solid composition. Thus, the method of the invention makes it possible to formulate highly alkaline compositions in which the total caustic content of the alkaline matrix and solid composition is increased from about 65–76% as found in conventional formulations, to about 80–90% as provided in the present compositions.

The cast or extruded alkaline matrix eventually hardens due, at least in part, to cooling and/or the chemical reaction of the ingredients. The solidification process may last from less than about one minute to about 2–3 hours, depending on, for example, the extruded matrix, the ingredients in the formulation, concentration of the alkaline source, the temperature of the alkaline matrix, and other like factors. Preferably, the cast or extruded alkaline matrix hardens to a solid form within about 1 minute to about 2 hours, preferably about 5–60 minutes.

Packaging System. The processed alkaline matrices of the invention may be cast or extruded into temporary molds from which the solidified compositions may be removed and transferred for packaging. The alkaline matrix may also be cast or extruded directly into a packaging receptacle. Extruded material may also be cut to a desired size and packaged, or stored and packaged at a later time.

The packaging receptacle or container may be rigid or flexible, and composed of any material suitable for containing a highly alkaline composition. In addition, it is preferred that the receptacle is capable of withstanding temperatures up to about 100° C. caused by the continued hydration of the hardening agent during solidification of processed composition, for example, glass, steel, plastic, cardboard, cardboard composites, paper, and the like. A preferred receptacle is a container comprised of a polyolefin such as polyethylene.

Advantageously, since the ingredients are processed at or near ambient temperatures, the temperature of the processed alkaline matrix is low enough so that the alkaline matrix may be cast or extruded directly into the container or other packaging receptacle without structurally damaging the receptacle material. As a result, a wider variety of materials may be used to manufacture the container than those used for compositions that are processed and dispensed under molten conditions.

It is highly preferred that the packaging used to contain the compositions is manufactured from a material which is biodegradable and/or water-soluble during use. Such packaging is useful for providing controlled release and dispensing of the contained cleaning composition. Biodegradable materials useful for packaging the compositions of the invention include, for example, water-soluble polymeric films comprising polyvinyl alcohol, as disclosed for example in U.S. Pat. No. 4,474,976 to Yang; U.S. Pat. No. 4,692,494 to Sonenstein; U.S. Pat. No. 4,608,187 to Chang;

U.S. Pat. No. 4,416,793 to Haq; U.S. Pat. No. 4,348,293 to Clarke; U.S. Pat. No. 4,289,815 to Lee; and U.S. Pat. No. 3,695,989 to Albert, the disclosures of which are incorporated by reference herein.

In addition, the alkaline matrix may be cast into a variety of shapes and sizes by extrusion since the viscosity of the alkaline matrix can be varied, for example, according to the amount of shear applied during mixing, the amount of hardening agent and water in the composition ingredients, temperature of the matrix, and other like factors. Also, unlike the "molten process," since the alkaline matrix is processed at a relatively low temperature, minimal cooling of the matrix is required prior to or after casting or extruding. The low temperature of the discharged material also enhances safety for those handling the material. In addition, the extruded or cast alkaline matrix will harden substantially simultaneously throughout its mass upon being discharged from the mixing system due to cooling and/or the chemical reaction of the ingredients in the matrix.

Since the present compositions comprise a highly caustic material, it is preferred that appropriate safety measures for handling such material are taken during manufacture, storage, dispensing and packaging of the processed composition. In particular, steps should be taken to reduce the risk of direct contact between the operator and the alkaline matrix during processing, the solid processed composition, and the washing solution that comprises the composition.

Dispensing of the processed compositions. It is preferred that a cleaning composition made according to the present invention is dispensed from a spray-type dispenser such as that disclosed in U.S. Pat. Nos. 4,826,661, 4,690,305, 4,687,121, and 4,426,362, the disclosures of which are incorporated by reference herein. Briefly, a spray-type dispenser functions by impinging a water spray upon an exposed surface of the solid composition to dissolve a portion of the composition, and then immediately directing the concentrate solution comprising the composition out of the dispenser to a storage reservoir or directly to a point of use.

The invention will be further described by reference to the following detailed examples. These examples are not meant to limit the scope of the invention that has been set forth in the foregoing description. Variation within the concepts of the invention are apparent to those skilled in the art. The disclosures of the cited references are incorporated by reference herein.

EXAMPLE I

Preparation of Cleaning Compositions Using Continuous Mixing System

Three cleaning compositions for use as an institutional warewash detergent were processed using a Teledyne 2" model continuous mixer in combination with a Breadsley Piper continuous speed flow mixer (Model 45) as described in U.S. Pat. No. 3,730,487 and U.S. Reissue Pat. No. RE 29,387.

The solid sodium hydroxide bead and 50% caustic were fed into the Teledyne continuous mixer which was set for high shear mixing to wet grind the caustic bead into the 50% caustic solution. The surfactant was then added to the caustic mixture. The mixture was then discharged directly into the Breadsley Piper continuous mixer, and the coated tripolyphosphate surfactant and encapsulated chlorine were added and mixed with the caustic mixture. The Breadsley mixer was set for low shear mixing of the ingredients. The material was then packaged into plastic tubs and allowed to solidify.

The formulations of the compositions and analytical results were as follows.

| INGREDIENT | Run #1 (wt-%) | Run #2 (wt-%) | Run #3 (wt-%) |
|---|---|---|---|
| NaOH, bead | 31.56 | 31.56 | 27.40 |
| NaOH, 50% | 29.14 | 29.14 | 25.30 |
| Surfactant[1] | 3.00 | 3.00 | 3.00 |
| Coated Tripoly[2] | 36.30 | 36.30 | 35.80 |
| Chlorine, encapsulated[3] | — | — | 8.50 |
| Phosphate, total (avg.) | 34.49 | 34.93 | 43.08 |
| Reverted Phosphate (avg.) | 2.17 | 5.13 | 2.00 |
| pH (1% solution) | — | 12.18 | 12.71 |
| Available chlorine (%) | — | — | 1.57 |

[1]Surfactant (LF-428-LBC): Benzyl ether of polyethoxylated linear alcohol with a cloud point (1% solution) at 60–64° F.
[2]Coated Tripoly: Large granular tripolyphosphate coated with 5% of a neutralized, dried polyacrylate acid with a molecular weight of about 4500.
[3]Per U.S. Pat. No. 4,618,914, a coated sodium dichloroisocyanurate dihydrate with two layers, the inner layer of a blend of sodium sulfate and sodium tripolyphosphate, and the outer layer of sodium octylsulfonate.

Results. All runs solidified with good retention of the active ingredient sodium tripolyphosphate, and available chlorine from the encapulated sodium dichloroisocyanurate.

EXAMPLE II

Preparation of Highly Alkaline Cleaning Composition Using Twin-Screw Extruder A cleaning composition for use as an institutional warewash detergent was prepared using a twin-screw extruder. The extruder was a five section, 62 mm, Buhler Miag twin-screw extruder (100 HP), manufactured by Buhler Miag, Inc. of Plymouth, Minn. USA. The first three sections (1–3) were set up for high shear mixing. The last two sections (4–5) were set up for low shear mixing.

The pressure at the discharge port was set at 60 psig. The die pressure without pipe was 44 psig, and die temperature was 98° F. The temperature of the section before the coated sodium tripolyphosphate feeder pipe was 69.8° F., and the section after was 73.4° F. The die pressure with pipe was 58 psig, and die temperature was 98° F.

The caustic bead was fed by a powder feeder into the powder feed port on the first section of the extruder. The 50% caustic solution was pumped into the first section of the extruder immediately after the powder feed port. The first three sections of the extruder, designed for high shear mixing provided wet milling of the beaded caustic in the 50% caustic. The feed rates for the powder and liquid feed streams are shown in the table below. A second feed port was located in the fourth section of the extruder through which the liquid surfactant and coated sodium tripolyphosphate were added to the wet milled, caustic mixture. The last two sections of the extruder were designed to blend the surfactant and coated tripolyphosphate into the wet milled, caustic mixture.

TABLE 1

| | FEED RATE LBS/HR Example No. | | | | | PERCENT FEED Example No. | | | | |
|---|---|---|---|---|---|---|---|---|---|---|
| | 1 | 2 | 3 | 4 | 5 | 1 | 2 | 3 | 4 | 5 |
| NAOH, bead | 152.4 | 186 | 193 | 229.6 | 254.5 | 31.32% | 36.58% | 37.44% | 41.59% | 44.11% |
| 50% NAOH | 141 | 126 | 126 | 126 | 126 | 28.98% | 24.78% | 24.44% | 22.82% | 21.84% |
| SURFACTANT[1] | 15 | 15 | 15 | 15 | 15 | 3.08% | 2.95% | 2.91% | 2.72% | 2.60% |
| COATED TRIPOLY[2] | 178.2 | 181.5 | 181.5 | 181.5 | 181.5 | 36.62% | 35.69% | 35.21% | 32.87% | 31.46% |
| TOTAL | 486.6 | 508.5 | 515.5 | 552.1 | 577 | 100.00% | 100.00% | 100.00% | 100.00% | 100.00% |
| % NAOH IN SOLID MATRIX | | | | | | 76.0% | 79.8% | 80.3% | 82.3% | 83.4% |

[1]Surfactant (LF-428-LBC): Benzyl ether of polyethoxylated linear alcohol with a cloud point (1% solution) at 60–64° F.
[2]Coated Tripoly: Large granular tripolyphosphate coated with 5% of a neutralized, dried polyacrylate acid with a molecular weight of about 4500.

The mixture of Example 1 formed a free flowing, easily molded material which solidified within 30 minutes of being discharged from the extruder. The mixtures of Examples 2 through 4 showed increasing viscosities and held some shape in the mold after being discharged. The mixture of Example 5 was a semi-solid as it was discharged from the extruder, and held a shape and solidified to that shape within 2 minutes of being discharged from the extruder. From Example 1 to Example 5, the viscosities of the mixture increased from a free flowing liquid (Example 1) to a semi-solid material which maintained its shape (Example 5). The increasing viscosity corresponded to an increasing concentration of caustic in the mixture from 76% to 83.4%.

EXAMPLE III

Wet Milling of Caustic Bead in Aqueous Caustic Solution

Two batches of a cleaning composition were prepared using a Ross Mixer to compare differences in wet milling time of the solid alkali in an aqueous solution. The ingredients were prepared in a Ross Mixer, Charles Ross and Son Co. (Model ME-100L) equipped with a stator head and fine screen head.

The ingredients were combined together as follows.

| Ingredients | Order of Addition | Grams | Percent |
|---|---|---|---|
| NaOH (bead)[1] | 1 | 437.13 | 32.09 |
| NaOH (50%)[2] | 1 | 403.50 | 29.63 |
| Surfactant[3] | 2 | 40.86 | 3.00 |
| Coated Tripolyphosphate[4] | 3 | 480.51 | 35.28 |
| | | 1362 gms | 100.00 |

[1]Sodium hydroxide beads, PPG.
[2]Sodium hydroxide, 50% solution, Valcon Chemical.
[3]Surfactant benzyl ether of a polyethoxylated linear alcohol.
[4]Coated Tripolyphosphate, large granular sodium tripolyphosphate (anhydrous) coated with 5% of a neutralized, dried polyacrylate acid with a molecular weight of about 4500.

For the first batch, the sodium hydroxide bead was wet milled in the 50% sodium hydroxide solution for 45 seconds at room temperature. The Ross mixer was set at a speed setting of about 5 to wet mill the solid alkali. The surfactant and coated tripolyphosphate were added to the caustic mixture and mixed in a standard laboratory mixer for an additional 3 minutes.

For the second batch, the caustic bead was wet milled for 3 minutes at the same speed, shear and temperature as the first run. The surfactant and coated tripolyphosphate were added and mixed at the same speed, shear and temperature as the first run, for the additional 3 minutes.

Penetrometer and Differential Scanning Calorimeter (DSC) readings were taken of each of the two batches at various intervals from time zero ($T_0$) up to 46 hours. The results of the penetrometer readings were as follows.

| Penetrometer Readings | | | | | |
|---|---|---|---|---|---|
| TIME | | READINGS | | | |
| (hrs) | (min) | 1ST | 2ND | 3RD | AVG |
| Run #1 (45 second milling time; Max. temp = 82° F.) | | | | | |
| | 0 | 327+ | 327+ | 327+ | 327+ |
| | 15 | 327+ | 327+ | 327+ | 327+ |
| | 30 | 278 | 251 | 309 | 279 |
| | 45 | 206 | 300 | 268 | 258 |
| 1 | 0 | 151 | 177 | 203 | 177 |
| 1 | 15 | 199 | 209 | 170 | 193 |
| 1 | 30 | 188 | 230 | 252 | 223 |
| 1 | 45 | 124 | 188 | 156 | 156 |
| 2 | 0 | 124 | 69 | 278 | 157 |
| 2 | 15 | 145 | 84 | 147 | 125 |
| 2 | 30 | 64 | 175 | 196 | 145 |
| 2 | 45 | 88 | 115 | 128 | 110 |
| 3 | 0 | 92 | 94 | 112 | 99 |
| 3 | 15 | 88 | 129 | 154 | 124 |
| 24 | 0 | 24 | 0 | 16 | 13 |
| 46 | 0 | 3 | 3 | 3 | 3 |
| Run #2 (3 minute milling time; Max. temp. = 106° F.) | | | | | |
| | 0 | 327+ | 327+ | 327+ | 327+ |
| | 15 | 269 | 155 | 116 | 180 |
| | 30 | 50 | 25 | 41 | 39 |
| | 45 | | | | |
| 1 | 0 | 23 | 6 | 33 | 21 |
| 1 | 15 | | | | |
| 1 | 30 | 0 | 17 | 0 | 6 |
| 1 | 45 | 16 | 27 | 29 | 24 |
| 2 | 0 | 0 | 8 | 2 | 3 |
| 24 | 0 | 0 | 0 | 0 | 0 |
| 41 | 30 | 0 | 0 | 3 | 1 |

RESULTS. The difference in solidification time for the two batches was significant. For the mixture in which the solid caustic was wet milled for 45 seconds, it took over 24 hours for the product to harden. By comparison, for the mixture in which the caustic was wet milled for 3 minutes, it took approximately 2 hours for the product to harden.

DSC Readings

DSC analyses were performed on the two batches at the following time intervals: 1, 6.5, 24, 36, 51, and 72 hours.

The results of the DSC analyses are shown below.

| TIME (hrs) | PEAK (° C.) | J/GM |
|---|---|---|
| | 45 second wet milling | |
| 1 | 67.45 | 8.64 |
| 6.5 | | |
| 24 | | |
| 46 | | |
| 51 | | |
| 76 | 66.13 | 47.47 |
| | 3 minute wet milling | |
| 1 | | |
| 17 | 68.02 | 66.07 |
| 24 | 65.81 | 68.51 |
| 41.5 | 65.69 | 80.03 |
| 48 | 67.52 | 78.97 |
| 72 | 67.83 | 74.27 |

Figure 2:
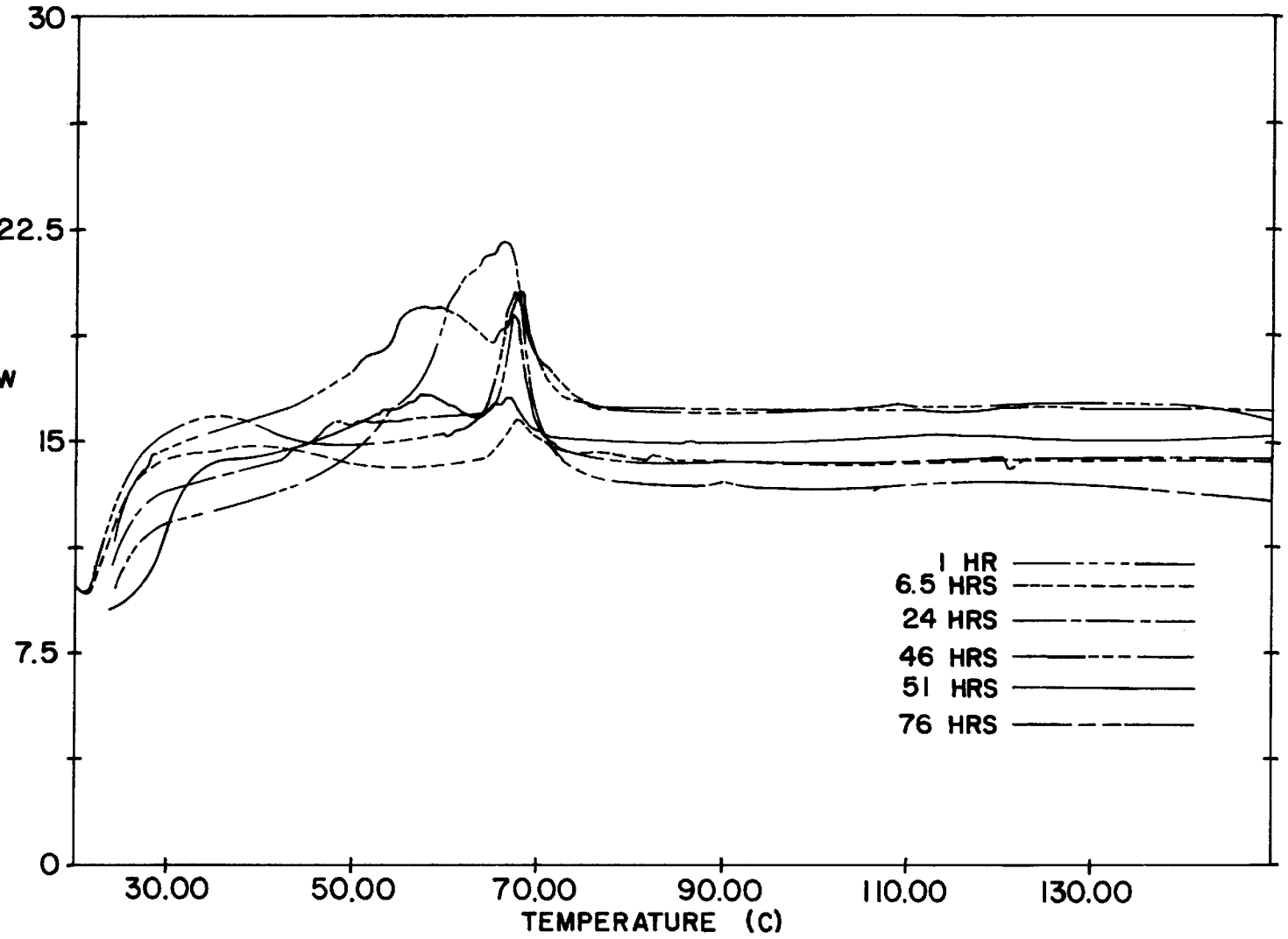
FIG. 2 is a graphic depiction of the DSC readings of a cleaning composition (first batch) for which the caustic bead was wet milled for 45 seconds (scanning rate 10.0 C/minute, sample weight 6.800 mg).

RESULTS. The difference in the DSC readings between the two batches was significant. For the second batch in which the solid caustic was wet milled for 3 minutes in the Ross mixer, the monohydrate of caustic developed rapidly (see also, FIG. 1). A significant monohydrate peak was seen after only 17 hours in the batch in which the solid alkali was milled for 3 minutes. For the batch in which the solid caustic was wet milled for 45 seconds, a significant monohydrate peak just started to form after 76 hours (see also, FIG. 2). These results indicate that reduced particle size of the caustic solid increases the rate at which the product solidifies.

EXAMPLE IV

Particle Size Reduction with Wet Milling

The following experiment was conducted to measure the amount of milling achieved at various time intervals using a Ross laboratory mixer. Mixtures containing 52% raw sodium hydroxide bead and 48% Kaydol mineral oil were milled in a Ross mixer at a speed setting of 5. After milling, between 7.5 and 13 grams of raw or milled bead were added to 75 grams of the mineral oil. The particle size of the solid alkali was then measured using a Lasentec particle size analyzer manufactured by Laser Sensor Technology Inc. (Model Lab-Tech 100™). Results showed a reduction of the raw bead having a mean particle size diameter of over 500 microns to a particle size of about 10 microns after three minutes of milling.

Another study was conducted in which caustic bead (NaOH) was wet milled in a 50% caustic (NaOH) solution. The solidification of the composition was measured over time using a penetrometer. The results are shown in the table below.

Caustic Milling Experiment rom Lasentec Particle Size Analyzer

| Mean particle[1] diameter(um) | Milling[1] Time(min) | Surface[1] Area um2/g | Solidification[2] Time(min) |
|---|---|---|---|
| 543.7 | 0 | 1 | 210 |
| 93.6 | 1 | 33.49 | 120 |
| 24 | 2 | 513.93 | 36 |
| 8.3 | 3 | 4295.49 | 32 |

[1]Data from mineral oil caustic bead wet milling experiments.
[2]Data from 50% caustic/caustic bead wet milling experiments.

Figure 3:
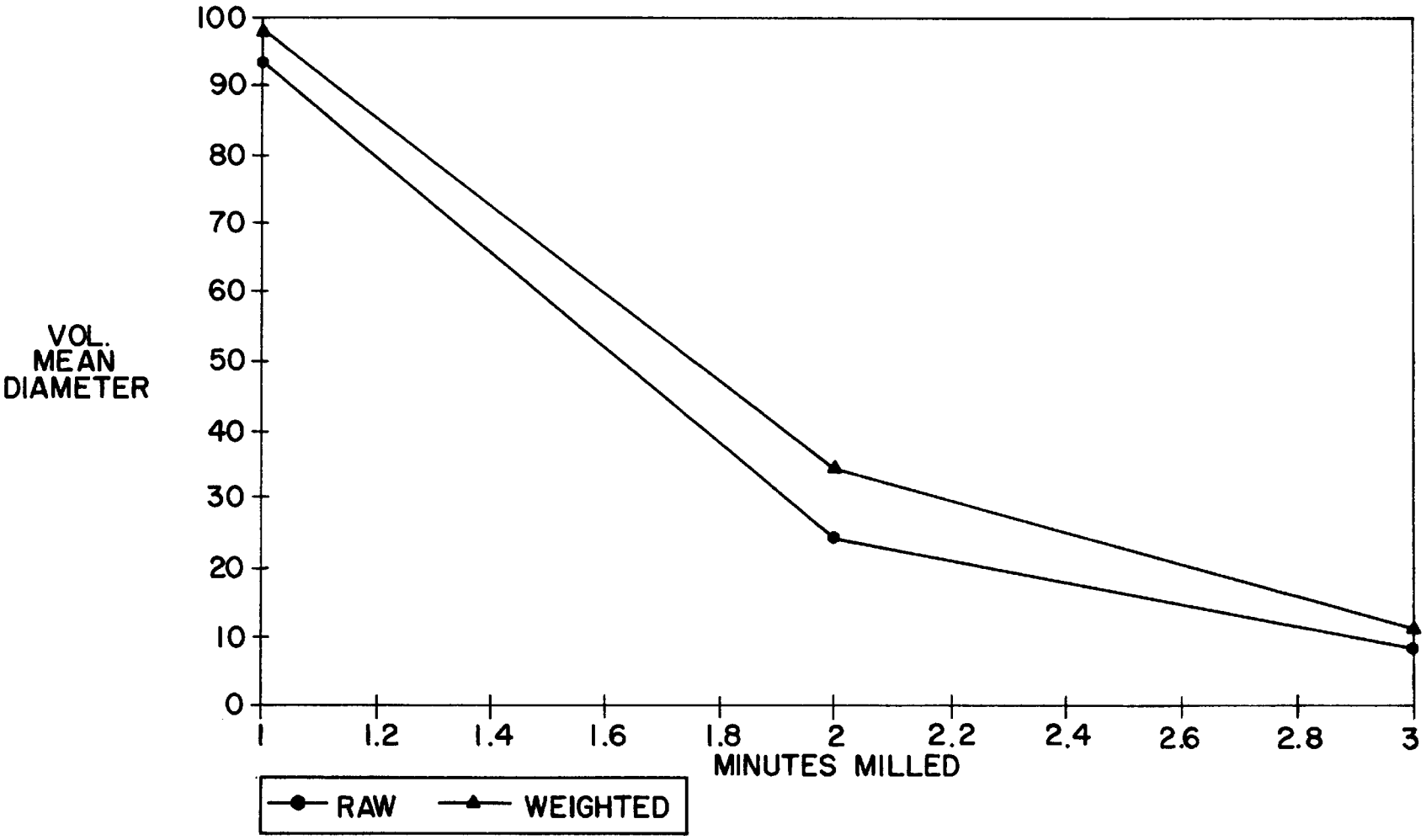
FIG. 3 is a graphic depiction of the surface area ($\mu m^2$/gm) of caustic compositions graphed against solidification time in minutes.
Figure 4:
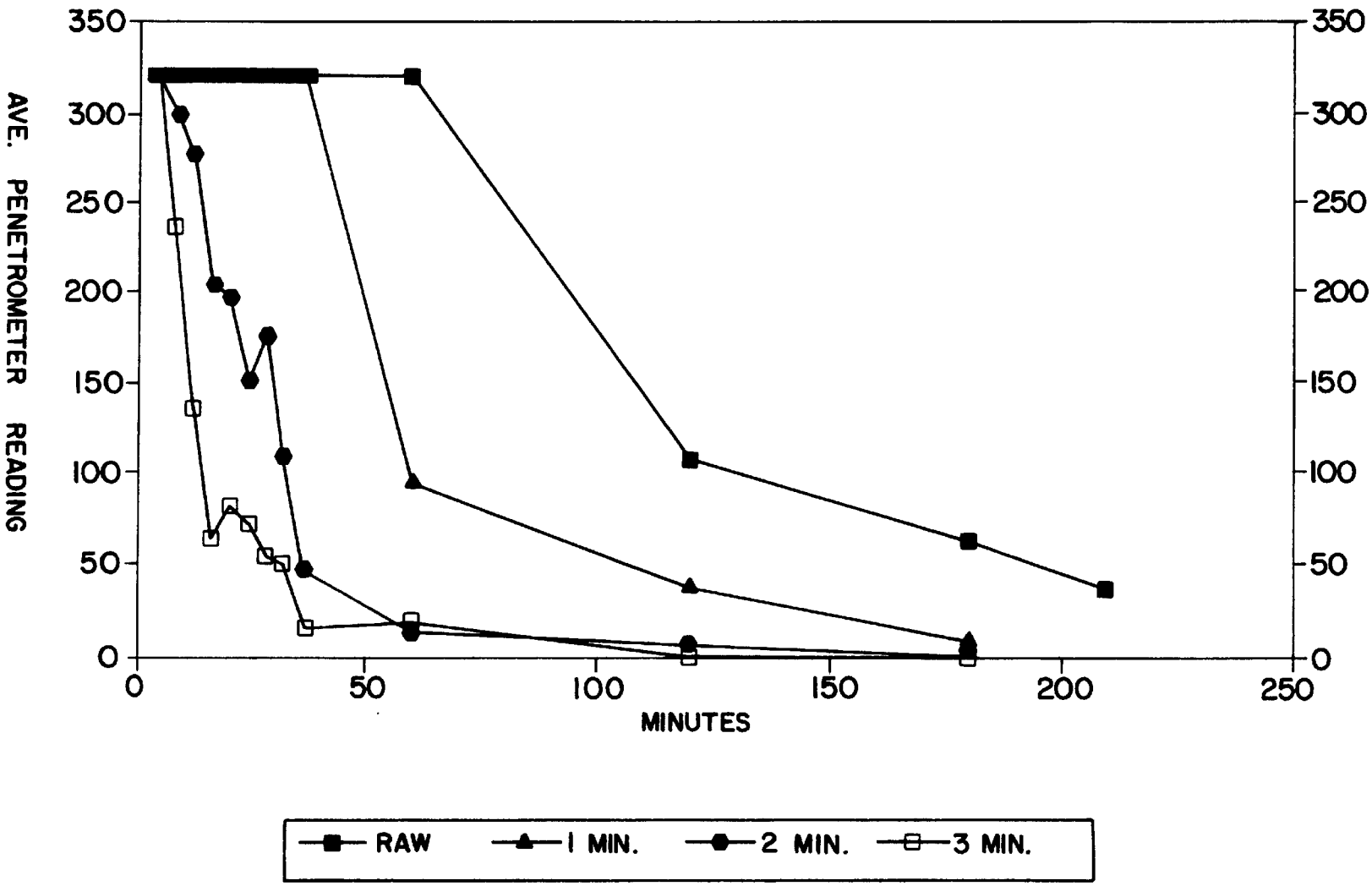
FIG. 4 is a graphic depiction of the average penetrometer readings of compositions containing wet milled caustic bead (raw unmilled bead, and 1, 2 and 3 minute milling times) against solidification time in minutes.

The results are calculated based on the mean particle size diameter obtained in the experiment described above. The surface area ($\mu^{m2}$) of each composition was calculated and graphed against solidification time (minutes) (see, FIG. 3). Also graphed was the average penetrometer reading versus solidification time (minutes) (see, FIG. 4). The results show that solidification rate of the processed composition increases with the increasing degree of wet milling and decreasing particle size of the solid alkali.

The mixtures were formed into capsules. The percentage of swell of the capsules after storage over 14 days was measured. The results showed that the degree of swelling increased as the amount of wet milling decreased, as shown in the table below).

EQ Caustic Milling Experiment from Lasentec Particle Size Analyzer

| MINUTES OF WET MILLING | % SWELL DAY 5 | % SWELL DAY 14 |
|---|---|---|
| 0 | 0.247 | 0.668 |
| 1 | 0.282 | 0.441 |
| 2 | 0.229 | 0.211 |
| 3 | 0.105 | 0.192 |

Figure 5:
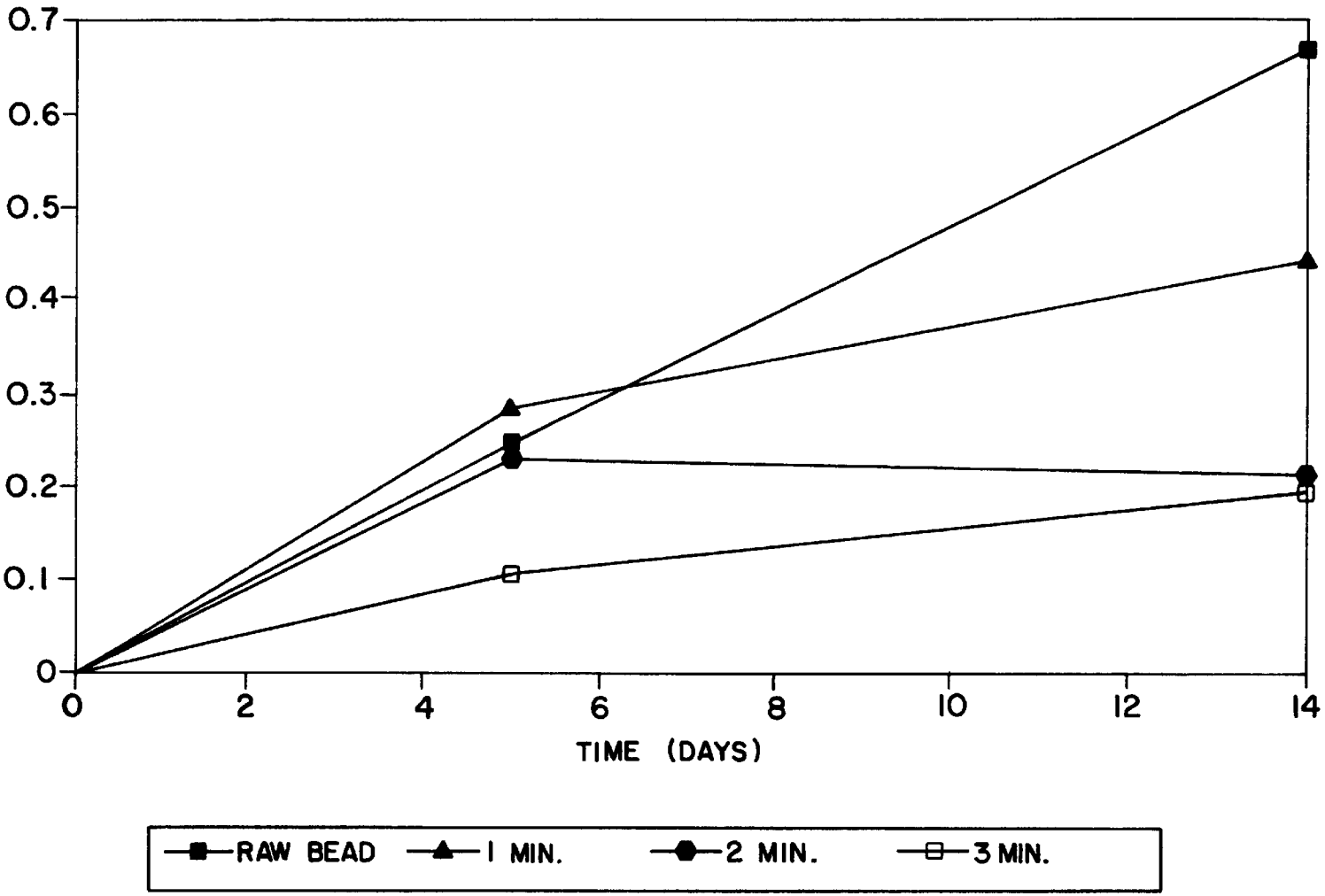
FIG. 5 is a graphic depiction of the swelling of capsules made from compositions containing raw unmilled caustic bead and wet milled caustic bead.

The capsules containing raw bead (unmilled) swelled significantly more and over a more extended time period compared to capsules containing the milled caustic bead (see, FIG. 5).

What is claimed is:

1. A homogeneous, highly alkaline, solid cleansing composition, produced by a process comprising the steps of:

(a) mixing by wet grinding or milling of a solid hydratable alkaline material comprising alkali metal hyroxide and an aqueous alkaline medium in a mixing system at a shear effective to reduce the solid alkaline material to a particle size effective to form a solid alkaline matrix by hydration of the alkaline material thereby increasing the rate of solidification and reducing swelling of the final product, and at a temperature below the melting point of the solid alkaline matrix, the total alkali metal hydroxide content of the solid alkaline matrix being about 80–90%; and (b) removing shear and discharging the alkaline matrix from the mixing system, causing the alkaline matrix to harden to a solid composition.

2. The composition according to claim 1, wherein the alkaline matrix in discharging step (b) has a viscosity effective to substantially sustain a shape upon being discharged from the mixer until solidifying to the solid composition.

3. The composition according to claim 2, wherein the alkaline matrix has a viscosity of about 1000–1,000,000 cps.

4. The composition according to claim 1, wherein the alkaline matrix hardens to the solid composition within about 1 minute to about 3 hours after discharging step (b).